United States Patent [19]

Rohner

[11] 4,438,621

[45] Mar. 27, 1984

[54] THREAD JOINING DEVICE

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 462,406

[22] Filed: Jan. 31, 1983

Related U.S. Application Data

[63] Continuation of Ser. No. 225,636, Jan. 16, 1981, abandoned.

[30] Foreign Application Priority Data

Jan. 19, 1980 [DE] Fed. Rep. of Germany ..... 3001917

[51] Int. Cl.[3] ..... B65H 69/06; D01H 15/00; D02J 1/08

[52] U.S. Cl. ..... 57/22; 28/274; 57/333

[58] Field of Search ..... 57/22, 23, 333, 350, 57/261; 28/271–276

[56] References Cited

U.S. PATENT DOCUMENTS

| | | | |
|---|---|---|---|
| 3,306,020 | 2/1967 | Rosenstein | 57/22 |
| 3,345,809 | 10/1967 | Gemeinhardt et al. | 57/22 |
| 3,407,583 | 10/1968 | Irwin et al. | 57/22 |
| 3,477,217 | 11/1969 | Bell et al. | 57/22 |
| 3,648,336 | 3/1972 | Bevington, Jr. | 57/22 X |
| 4,002,012 | 1/1977 | Norris et al. | 57/22 |

*Primary Examiner*—John Petrakes

*Attorney, Agent, or Firm*—Herbert L. Lerner; Laurence A. Greenberg

[57] ABSTRACT

Thread joining device, including a stationary basic body having a channel for compressed air formed therein, a splicing head having formed therein a splicing chamber for inserting and joining threads and a compressed air channel for communication between the splicing chamber and the channel formed in the basic body, and means for easily exchangeably fastening the splicing head to the basic body.

6 Claims, 10 Drawing Figures

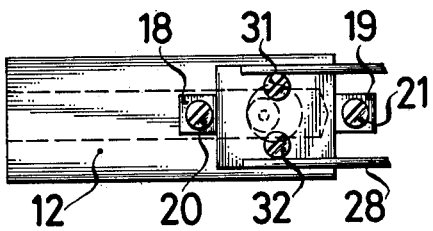
FIG.2
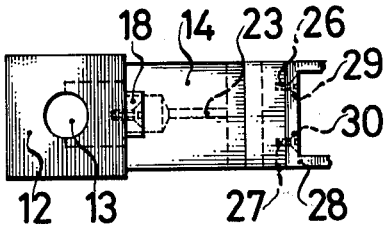
FIG.3
FIG. 1
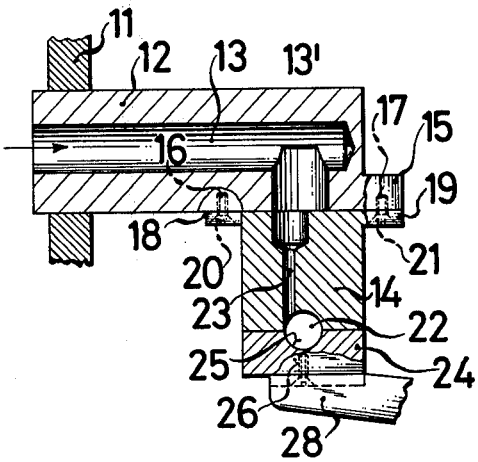
FIG. 4
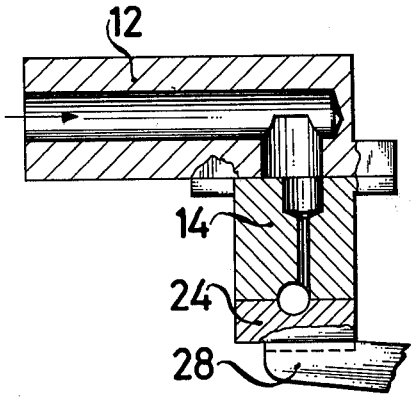

THREAD JOINING DEVICE

This is a continuation of application Ser. No. 225,636, filed 1/16/81 and now abandoned.

The invention relates to a thread joining device with a splicing head, including a splicing chamber, in some cases with a longitudinal groove for inserting and joining the threads which is bridged by a cover, a channel for compressed air leading into the splicing chamber, and in some cases a cover or lid for transitory or temporary covering of the longitudianl groove.

A thread joining device of this type has been made known by German Published Non-Prosecuted Application DE-OS 28 10 741, for example.

The usability of the known thread joining device is limited. For different threads and yarns, such as long-fiber yarns and short-fiber yarns, and for different yarn strength and different yarn twist, one and the same splicing head cannot be successfully used.

It is accordingly an object of the invention to provide a thread joining device which overcomes the hereinafore-mentioned disadvantages of the heretofore-known devices of this general type, and one which can be quickly adapted to effectively join different yarns, threads or filaments.

With the foregoing and other objects in view there is provided, in accordance with the invention, a thread joining device, comprising a stationary basic body having a channel for compressed air formed therein, a splicing head having formed therein a splicing chamber for inserting and joining threads and a compressed air channel for communication between the splicing chamber and the channel formed in the basic body, and means for easily exchangeably fastening the splicing head to the basic body.

In accordance with another feature of the invention, the splicing head has a longitudinal groove formed therein forming the splicing chamber, and there is provided a cover bridging the longitudinal groove.

In accordance with a further feature of the invention, there is provided a movable holder for the cover, and means for easily exchangeably fastening the cover to the splicing head at the holder.

In accordance with an added feature of the invention, the channel formed in the splicing head is eccentrically disposed with respect to the splicing chamber and the splicing head is rotatable for changing the direction of compressed air entering the splicing chamber.

In accordance with a concomitant feature of the invention, the fastening means are in the form of screw fasteners or spring clamps and pins.

The advantages obtained with the invention are especially the feature that when a batch change occurs in the machine in which threads are to be spliced, one and the same thread joining device can be optimally adapted to the respective batch by a simple manipulation every time. A small assortment of different splicing heads and covers are sufficient. There is no need for an assortment of different thread joining devices. Also, experimental thread joints can be made easily and rapidly with unusual thread material for selecting the correct splicing head.

Other features which are considered as characteristic for the invention are set forth in the appended claims.

Although the invention is illustrated and described herein as embodied in a thread joining device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary diagrammatic cross-sectional view, partly broken away, through a thread joining device;

FIG. 2 is a front-elevational view of FIG. 1;

FIG. 3 is a side-elevational view of FIG. 1;

FIG. 4 is a view similar to FIG. 1 through the same thread joining device, however, the splicing head is turned through an angle of 180°;

Figure 7:
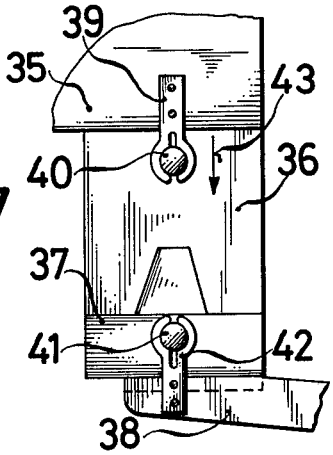
Figure 8:
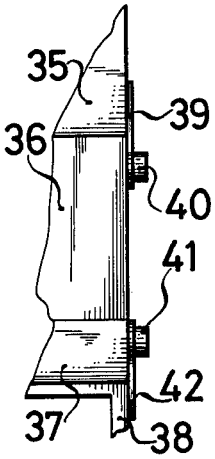
Figure 9:
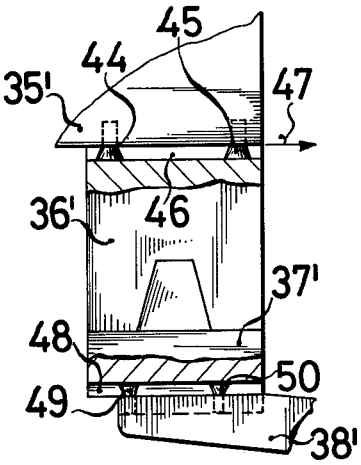
Figure 10:
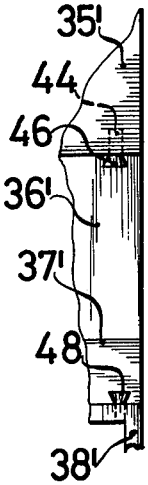

FIGS. 7 and 8 are fragmentary diagrammatic elevational views showing a different way of fastening the splicing head to the basic body; and FIGS. 9 and 10 are views similar to FIGS. 7 and 8 showing another possibility of securing the splicing head.

Referring now to the figures of the drawing, and first particularly to FIGS. 1 to 3 thereof, there are seen in the first embodiment of the thread joining device according to the invention, which includes only its essential details, a frame 11 which carries the basic body 12. The basic body 12 contains an angled channel 13, 13' which conducts compressed air. Furthermore, the basic body 12 has fastening means for the splicing head 14 including a pad 15, and two countersunk threaded holes 16, 17.

The splicing head 14 has fastening means, including two lugs 18, 19, and two flat-head screws 20, 21, which engage in the threads of the countersunk holes 16, 17, and thereby connect the splicing head 14 to the basic body 12 in a manner which permits easy exchangeability. The splicing head 14 includes a splicing chamber 22, in the form of a longitudinal groove formed therein. A channel 23 ends in the splicing chamber 22, the channel being in connection with the compressed air channel 13' of the basic body 12. The splicing head 14 can be covered by a cover 24. The cover 24 is also provided with a longitudinal groove 25 formed therein, so that the splicing chamber 22, as a whole, has a circular cross section when the cover is closed. The compressed air channel 23 ends eccentrically in the thus-formed splicing chamber 22.

The cover 24 also has fastening means which in this embodiment includes two threaded countersunk holes 26, 27. The cover 24 is held by a hingeable cover holder 28. The cover holder 28 also has fastening means in the form of two holes 29, 30, which are occupied by two flat-head screws 31, 32 that engage in the threads of the countersunk holes 26, 27 of the cover 24.

The direction of the twist of the compressed air flowing into the splicing chamber 22 can be changed by turning the splicing head 14. The embodiment according to FIG. 4 shows the above-described device with the splicing head turned through 180°.

Figure 5:
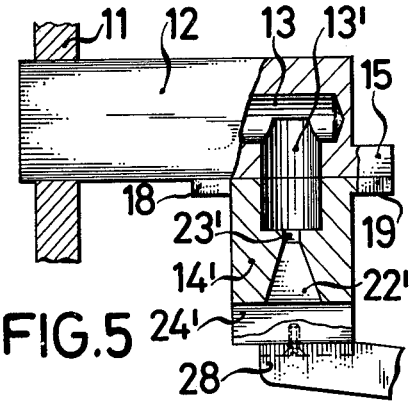
FIG. 5 is another view similar to FIG. 1 of a thread joining device in partial cross section with a differently constructed splicing chamber.
Figure 6:
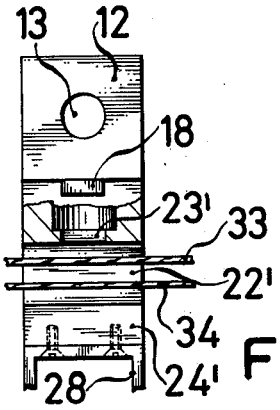
FIG. 6 is a side-elevational and partial cross-sectional view of FIG. 5.

In the embodiment of the invention according to FIGS. 5 and 6, the same basic body and the same cover holder are used as in the typical embodiment according to FIGS. 1 to 3. However, the splicing head 14' is differently constructed; its splicing chamber 22' has the form of a prismatically-shaped, longitudinal groove. The compressed air channel 23' leads centrally into the splicing chamber 22'. The cover 24' does not have a longitudinal groove; it is connected with the cover holder 28 in the same manner as in the embodiment according to FIGS. 1 to 3.

FIG. 6 additionally shows the threads 33, 34 ready for splicing. The splicing chamber 22' of this embodiment is suitable for long-fiber yarns and highly twisted yarns, while the splicing chamber 22 of the preceding embodiment is better suited for short-fiber yarns. One splicing head can be exchanged for the other, and one cover can be exchanged for the other with little manipulation. The changing of splicing heads and of the covers is still more easily effected if push-on connections are used as the fastening means. For example, in the embodiment according to FIGS. 7 and 8, the basic body 35 is connected to the splicing head 36, and the cover 37 is connected to the cover holder 38 by push-on connections as shown. More specifically, the fastening means of the basic body 35 are spring clamps 39 and the holding means of the splicing head 36 include headed pins 40. The fastening means of the cover 37 also are headed pins 41, and the fastening means of the cover holder 38 are the spring clamps 42.

If it is desired to change the splicing head 36, the head is simply pulled-off from the basic body 35 in direction of the arrow 43. The attachment is effected in the reverse direction, so that the spring clamps seat in the header pins.

The embodiment of the invention according to FIGS. 9 and 10 shows a different possibility for securing the splicing head. The fastening means of the basic body 35' in this embodiment includes concial pins 44, 45 having tapers that increase toward the outside. There are two rows of such pins provided, but in FIG. 9 only one row with both pins 44 and 45 is shown.

In FIGS. 9 and 10 the fastening means of the splicing head 36' includes two dove-tail shaped recesses 46, of which also only one is shown. If the splicing head 36' is to be changed, it must be pulled off the conical pins 44 and 45 in the direction of the arrow 47. The mounting is effected in the reverse direction.

In a similar manner, the fastening means of the cover 37' include dove-tail shaped recesses 48, and the fastening means of the cover holder 38' include conical pins 49, 50.

The invention is not limited to the illustrated and described embodiments. For example, positive locking push-on devices, such as bayonet closures, and the like, can serve as the fastening means. In any case, the splicing head must be fixedly connected to the basic body, so it does not become loose or come off unintentionally during operation.

There are claimed:

1. Thread joining device, comprising a basic body stationary with respect to threads to be joined, said basic body having a first channel for compressed air formed therein, a plurality of splicing heads for accommodating respective threads of different type, each of said splicing heads having formed therein a splicing chamber for inserting and joining threads and a second compressed air channel for communication between said splicing chamber and said first channel formed in said basic body, and means for interchangeably fastening one of said splicing heads selectively to said basic body in accordance with the type of threads to be joined.

2. Thread joining device according to claim 1, wherein said splicing heads have a longitudinal groove formed therein forming said splicing chamber, and including a cover bridging said longitudinal groove.

3. Thread joining device according to claim 2, including a movable holder for said cover, and means for easily exchangeably fastening said cover to the respective splicing head at said holder.

4. Thread joining device according to claim 3, wherein said means for fastening said cover to said splicing heads, respectively, are in the form of screw fasteners.

5. Thread joining device according to claim 3, wherein said means for fastening said cover to said splicing heads, respectively, are in the form of spring clamps and pins.

6. Thread joining device according to claim 1, wherein said second channel formed in said splicing heads is eccentrically disposed with respect to said splicing chamber and said splicing heads are rotatable for changing the direction of compressed air entering said splicing chamber.

* * * * *